US008662165B2

(12) United States Patent
Earles et al.

(10) Patent No.: US 8,662,165 B2
(45) Date of Patent: Mar. 4, 2014

(54) FIBER SUPPORT ARRANGEMENT AND METHOD

(75) Inventors: Denise M. Earles, Houston, TX (US); Carl W. Stoesz, Christiansburg, VA (US)

(73) Assignee: Baker Hughes Incorporated, Houston, TX (US)

( * ) Notice: Subject to any disclaimer, the term of this patent is extended or adjusted under 35 U.S.C. 154(b) by 529 days.

(21) Appl. No.: 12/830,768

(22) Filed: Jul. 6, 2010

(65) Prior Publication Data

US 2012/0006566 A1 Jan. 12, 2012

(51) Int. Cl.
*E21B 17/10* (2006.01)

(52) U.S. Cl.
USPC ..... 166/241.1; 166/242.1; 166/250.01; 166/227; 385/100; 385/102

(58) Field of Classification Search
USPC ..... 166/241.1, 242.1, 250.01, 227, 378; 385/100, 102
See application file for complete search history.

(56) References Cited

U.S. PATENT DOCUMENTS

| | | | | |
|---|---|---|---|---|
| 3,788,304 | A | 1/1974 | Takahashi | |
| 4,927,232 | A | 5/1990 | Griffiths | |
| 5,767,411 | A | 6/1998 | Maron | |
| 5,892,860 | A | 4/1999 | Maron et al. | |
| 6,233,374 | B1 | 5/2001 | Ogle et al. | |
| 6,278,811 | B1 | 8/2001 | Hay et al. | |
| 6,374,913 | B1 | 4/2002 | Robbins et al. | |
| 6,563,970 | B1 | 5/2003 | Bohnert et al. | |
| 6,614,723 | B2 | 9/2003 | Pearce et al. | |
| 7,003,184 | B2 | 2/2006 | Ronnekleiv et al. | |
| 7,245,791 | B2 | 7/2007 | Rambow et al. | |
| 7,315,666 | B2 * | 1/2008 | Van Der Spek | 385/12 |
| 7,398,697 | B2 | 7/2008 | Allen et al. | |
| 7,512,292 | B2 | 3/2009 | MacDougall et al. | |
| 2002/0000794 | A1 | 1/2002 | Bayne et al. | |
| 2002/0066309 | A1 | 6/2002 | Paulo et al. | |
| 2002/0088744 | A1 | 7/2002 | Echols et al. | |
| 2003/0056947 | A1 | 3/2003 | Cameron | |
| 2006/0115203 | A1 | 6/2006 | Wait et al. | |
| 2007/0237467 | A1 | 10/2007 | Rubinstein et al. | |
| 2008/0047662 | A1 | 2/2008 | Dennis et al. | |
| 2008/0142212 | A1 | 6/2008 | Hartog et al. | |
| 2008/0245533 | A1 * | 10/2008 | Coronado et al. | 166/378 |
| 2009/0252464 | A1 * | 10/2009 | Stoesz et al. | 385/100 |

FOREIGN PATENT DOCUMENTS

GB 2408527 A 6/2005

OTHER PUBLICATIONS

PCT Search Report and Written Opinion PCT/US2008/058417; Mailed Aug. 21, 2008; International Search Report 6 Pages and Written Opinion 7 Pages.

(Continued)

*Primary Examiner* — Yong-Suk (Philip) Ro
(74) *Attorney, Agent, or Firm* — Cantor Colburn LLP

(57) ABSTRACT

A fiber support arrangement for a downhole tool includes at least one tubular and at least one bracket positioning the at least one tubular spaced radially from a downhole tool and lacking contact therewith. At least two fibers are supported at the at least one tubular with at least two of the at least two fibers having a different helical angle from one another relative to an axis of the downhole tool.

19 Claims, 4 Drawing Sheets

(56) References Cited

OTHER PUBLICATIONS

Ren L et al., "Application of Tube-Packaged FBG Strain Sensor in Vibration Experiment of Submarine Pipeline Model" China Ocean Engineering, Haiyang Chubanshe, Bejing, CN, vol. 20, No. 1, Jan. 1, 2006, pp. 155-164.

Restarick, Henry; "Horizontal Completion Options in Reservoirs With Sand Problems"; SPE29831; SPE Middle East Oil Show, Bahrain; Mar. 11-14, 1995; pp. 545-560.

Notification of Transmittal of the International Search Report and the Written Opinion of the International Searching Authority; PCT/US2011/043041; Korean Intellectual Property Office; Mailed Jan. 5, 2012.

* cited by examiner

FIBER SUPPORT ARRANGEMENT AND METHOD

BACKGROUND

The downhole drilling and completion industry in recent years has increasingly discovered uses for optical fiber in signal conductance and sensory applications for the downhole environment. In view of the harshness of that environment, the delicate optical fibers must be protected yet disposed optimally to sense desired parameters to conduct signals to desired end devices.

In a sensory capacity, the fiber must be exposed to the parameter being measured to be able to register that parameter, strain as a parameter presents a particular difficulty because of the need for the fiber to be protected but also to be exposed to the strain in the environment being sensed. Solutions to the foregoing are well received by and beneficial to the art.

BRIEF DESCRIPTION

Disclosed herein is a fiber support arrangement for a downhole tool which includes at least one tubular and at least one bracket positioning the at least one tubular spaced radially from a downhole tool and lacking contact therewith. At least two fibers are supported at the at least one tubular with at least two of the at least two fibers having a different helical angle from one another relative to an axis of the downhole tool.

Further disclosed is a method for supporting fibers at a downhole tool. The method includes strain transmissively mounting each of at least two fibers at a downhole tool in radial spaced relation to the downhole tool without contact therewith and in different helical angles relative to an axis of the downhole tool.

Further disclosed is a method for supporting fibers at a downhole tool including disposing a support at a downhole tool, wherein the support is radially outwardly positioned of the downhole tool. Supporting the support with at least two brackets axially spaced from each end of the downhole tool such that the downhole tool is lacking contact with the support and mounting at least two fibers at the support such that the at least two fibers lack contact with the downhole tool and have different helical angles relative to an axis of the downhole tool.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
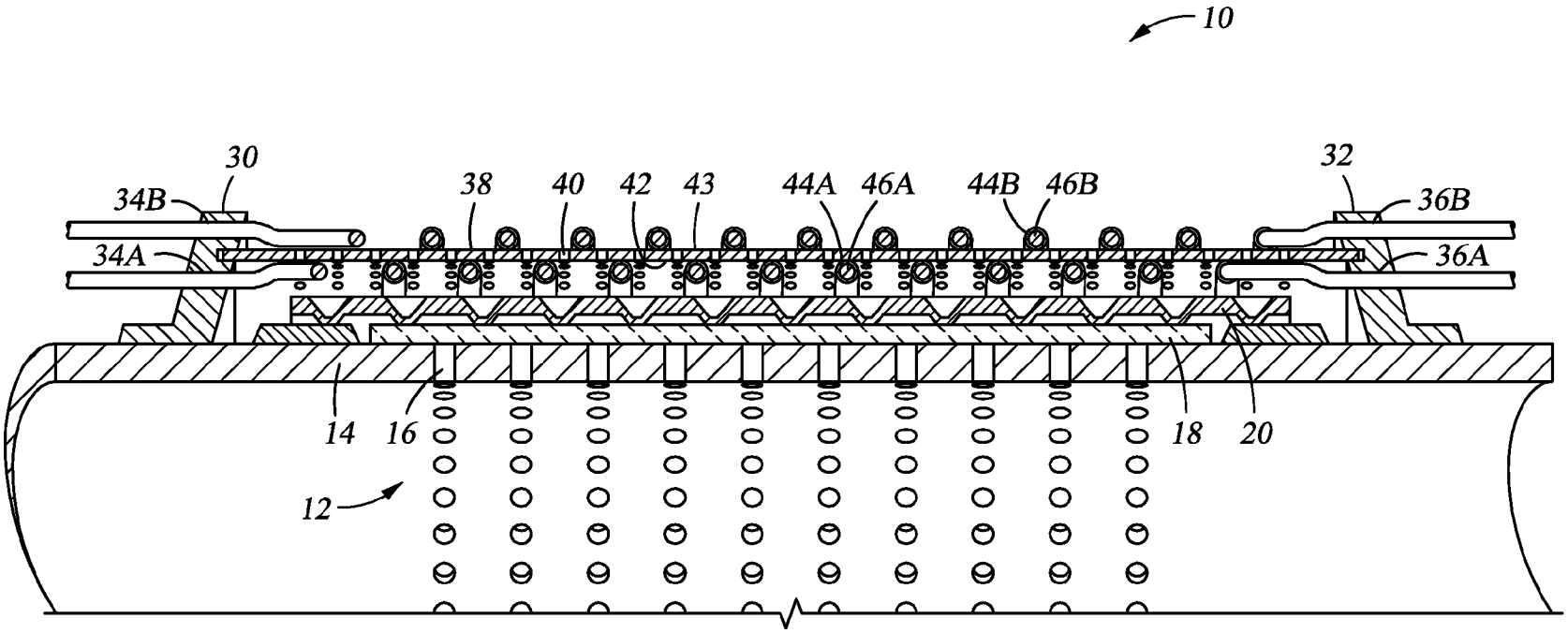
FIG. 1 depicts a schematic cross-sectional view of a fiber support arrangement disclosed herein.

Referring to FIG. 1, a fiber support arrangement for a downhole tool is illustrated at 10. In the FIG. 1 embodiment, the fiber support arrangement 10 is illustrated at a downhole tool shown herein as sand screen assembly 12 comprising a base pipe 14 having holes 16, a filter media 18 and a shroud 20. The sand screen assembly 12 as illustrated is similar to a commercially available product from Baker Oil Tools, Houston, Tex. under product number H48690, and as such does not require detailed further explanation but rather has been identified merely for environment and to provide an understanding of relative positioning.

The fiber support arrangement 10 comprises at least one end ring or bracket and as illustrated two end rings 30 and 32 each having at least two fiber pass throughs 34A, 34B and 36A, 36B, respectively and which may be sized to allow pass through of a fibers 46A, 46B, respectively alone or the fibers 46A, 46B inside of conduits 44A, 44B, respectively. End rings 30 and 32 have a radial dimension y sufficient to ensure a clearance between the sand screen assembly 12 (or other downhole tool) and a fully assembled fiber support arrangement 10 such that contact between the fiber support arrangement 10 and the sand screen assembly 12 (or other downhole tool) does not occur. The end rings 30, 32 may be fully annular structures or may be segmented as desired.

One of the pass throughs 34A and 36A of each of the end rings 30, 32 is positioned radially inwardly of a tubular 38 while the other of the pass throughs 34B, 36B is positioned radially outwardly of the tubular 38. These radial positional relationships allow the fiber 46A and the conduit 44A positioned radially inwardly of the tubular 38 to have a different helical angle with respect to an axis of the downhole tool 12 than the fiber 46B and the conduit 44B positioned radially outwardly of the tubular 38.

The tubular 38, which may be metal, is perforated and extends from the end ring 30 to the other end ring 32, the perforations being identified with the numeral 40. The fiber conduits 44A are at an inside dimension surface 42 and the fiber conduits 44B are at an outside dimension surface 43 of the tubular 38, and in one embodiment are strain transmissively disposed thereat. It is to be understood that in other embodiments, the fiber conduits 44A, 44B are disposed to facilitate the fibers 46A, 46B therein measuring or sensing temperature, seismic, pressure, chemical composition, etc. The conduits 44A, 44 B may be metal tubes such as quarter inch, eighth inch or sixteenth inch stainless steel tubulars, for example. In one embodiment, the conduits 44A, 44B are welded by, for example, an induction welding technique to their respective surfaces 42, 43 of tubular 38. In another embodiment, the fiber conduits 44A, 44B are mechanically or adhesively attached to the surfaces 42, 43 (it is to be understood that adhesive processes are intended to include soldering and brazing processes). Broadly stated, any means of attachment of the fiber conduits 44A, 44B to the tubular 38 that allows for, in one embodiment, transmission of strain in the tubular 38 to the fiber conduits 44A, 44B without significant loss of magnitude or at least a reliably predictable loss in magnitude or in other embodiments facilitating or at least not hindering the measurement or sensing of such properties as seismic, temperature, pressure, chemical composition, etc. is sufficient for purposes of the invention disclosed herein. It is to be understood that combinations of sensitivities are also contemplated wherein one or more of the exemplary properties are sensed or combinations including at least one of the exemplary properties are sensed.

In order to ensure optimal function of the fibers 46A, 46B installed in the fiber conduits 44A, 44B, consideration must be given to the means of attachment of the fiber conduits 44A, 44B to the tubular 38. This is particularly true if a welding process or other heat intensive process is to be used for the affixation of the fiber conduits 44A, 44B to the tubular 38. Depending upon the heat to be applied and the resistance to heat damage a particular type of optical fiber 46A, 46B exhibits, it is possible to place the fiber 46A, 46B in the conduit 44A, 44B before welding (or other heat process) or alternatively creates a requirement to place the fiber 46A, 46B in the conduit 44A, 44B after welding (or other heat process).

Regardless of process of attachment, the fibers 46A, 46B (either before or after conduit attachment) are installed in the conduits 44A, 44B, the conduits 44A, 44B or the fibers 46A, 46B being adapted to allow the fibers 46A, 46B to sense the target property. In one embodiment the fibers 46A, 46B are embedded in a strain transmissive potting substance such as for example, epoxy inside the conduits 44A, 44B. Such substance ensures that strain in the conduits 44A, 44B, transmitted thereto by the tubular 38, is in turn transmitted to the fibers 46A, 46B where it will effect a frequency shift in the transmission wavelength of the fibers 46A, 46B thus indicating at a remote location a strain and its magnitude.

In one embodiment of the support arrangement 10, a strip of perforated material is helically wound about an axis and welded at sides thereof to create the tubular form. This method is known to the art but pointed out here for the purpose of noting that the conduits 44A, 44B may be strain transmissively or otherwise disposed at the strip before the strip is helically wound, as the strip is helically wound or after the strip is helically wound, as desired. If the conduits 44A, 44B are disposed at the strip before it is helically wound the conduits 44A, 44B must be positioned nonparallel to one another to assure non-common helical angles between them after the strip has been helically wound. In the event the conduits 44A, 44B are to be attached after the strip is wound i.e. after tubular 38 is formed, then it is desirable to helically wind the conduits 44A, 44B first and install them to the tubular 38 as helical coils prior to strain transmissive disposition thereof.

The completed tubular 38 and conduits 44A, 44B are disposed between the end rings 30 and 32 and secured there permanently. The conduits 44A, 44B, as shown extend beyond the end rings 30 and 32 through pass throughs 34A, 34B and 36A, 36B, respectively, and then to connectors (not shown).

As is illustrated, the conduits 44A, 44B are spaced from the sand screen assembly shroud 20 so as to make no contact therewith when installed. As is illustrated, the fiber support arrangement 10 is attached to the base pipe 14 axially outside of the attachment points of the screen filter media 18 and shroud 20 and may be at the ends of such base pipe 14, if desired. As one of skill in the art will anticipate, one means of attachment of the end rings 30 and 32 to the base pipe 14 is by welding as shown.

While the embodiment illustrated in FIG. 1, supports the conduits 44A, 44B on opposing surfaces 42, 43 of the tubular 38 it should be noted that consideration should be given to a risk of mechanically induced damage to the conduit 44B being on the outside surface 43 and thus lacking protection from the tubular 38 in such position, especially while running.

Figure 2:
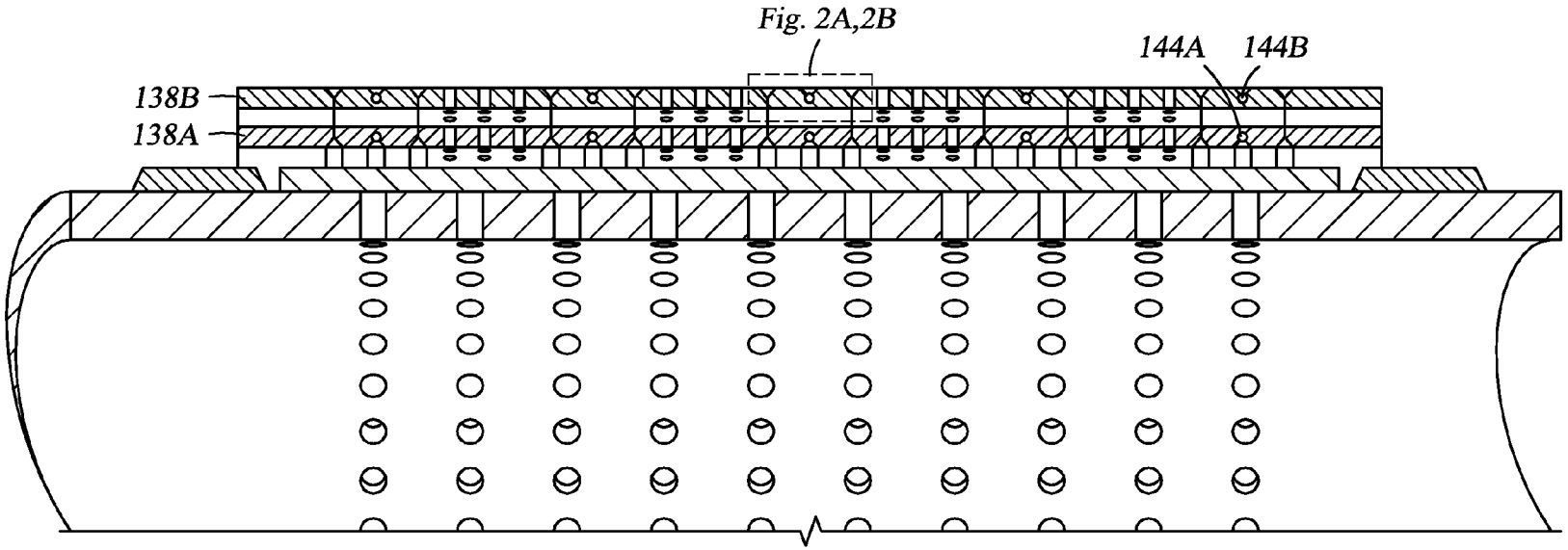
FIG. 2 depicts a schematic cross-sectional view of another embodiment of a fiber support arrangement disclosed herein.
Figure 2B:
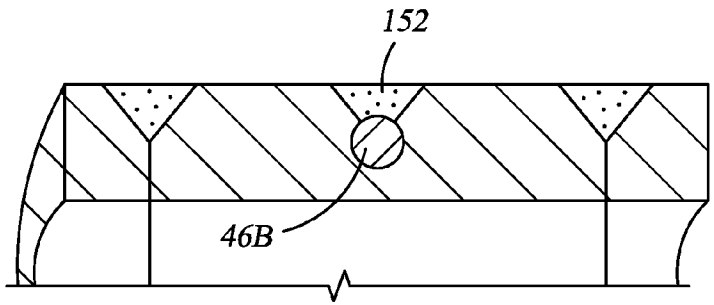
FIG. 2B depict the enlarged detail view of circumscribed area 2A, 2B of FIG. 2 after being closed.
Figure 2A:
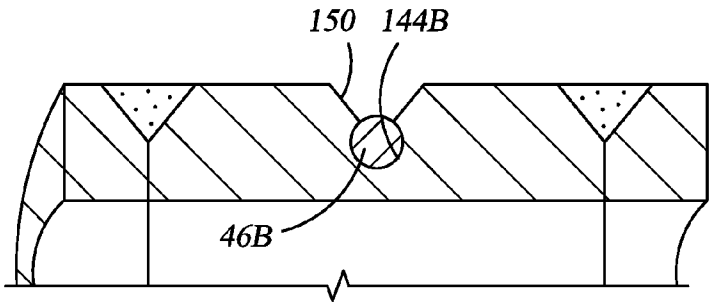
FIG. 2A is an enlarged detail view of circumscribed area 2A, 2B in FIG. 2 prior to being closed.

In another embodiment, referring to FIG. 2, most of the components are the same and are therefore not described or in some cases illustrated. What is distinct are tubulars 138A and 138B, which are analogous to the tubular 38 with regard to positioning and support. Tubulars 138A, 138B, instead of separately supporting the fiber conduits 44A, 44B, create conduits 144A, 144B for the optic fibers 46A 46B. In this embodiment, the material, which may be metal, of the tubular 138A, 138B is split about half way through a thickness thereof. Detail illustrations in FIGS. 2A and 2B will enhance understanding hereof. In FIG. 2A, the material of the tubular 138B is illustrated with a cleft 150 open for insertion of the fiber 46B (shown inserted), which may be configured to sense temperature, pressure, seismic, chemical composition and may in one embodiment include a strain transmissive potting material such as epoxy around the fiber 46B. FIG. 2B illustrates the cleft 150 closed and permanently fused by a process such as welding or adhesive or mechanical process as appropriate. In FIG. 2B, the process illustrated is welding at weld bead 152. Although only the tubular 138B is shown magnified in FIGS. 2A and 2B, it should be understood that the tubular 138A has similar details, albeit mirror images thereof. Additionally, the tubulars 138A, 138B may be connected to the end rings 30, 32 (not shown in this view).

In other respects, the FIG. 2 embodiment is similar to the FIG. 1 embodiment including creation of the tubulars 138A, 138B from strips. In its final assembled position, tubulars 138A, 138B are again spaced from the sand screen assembly 12 as is tubular 38.

Figure 3:
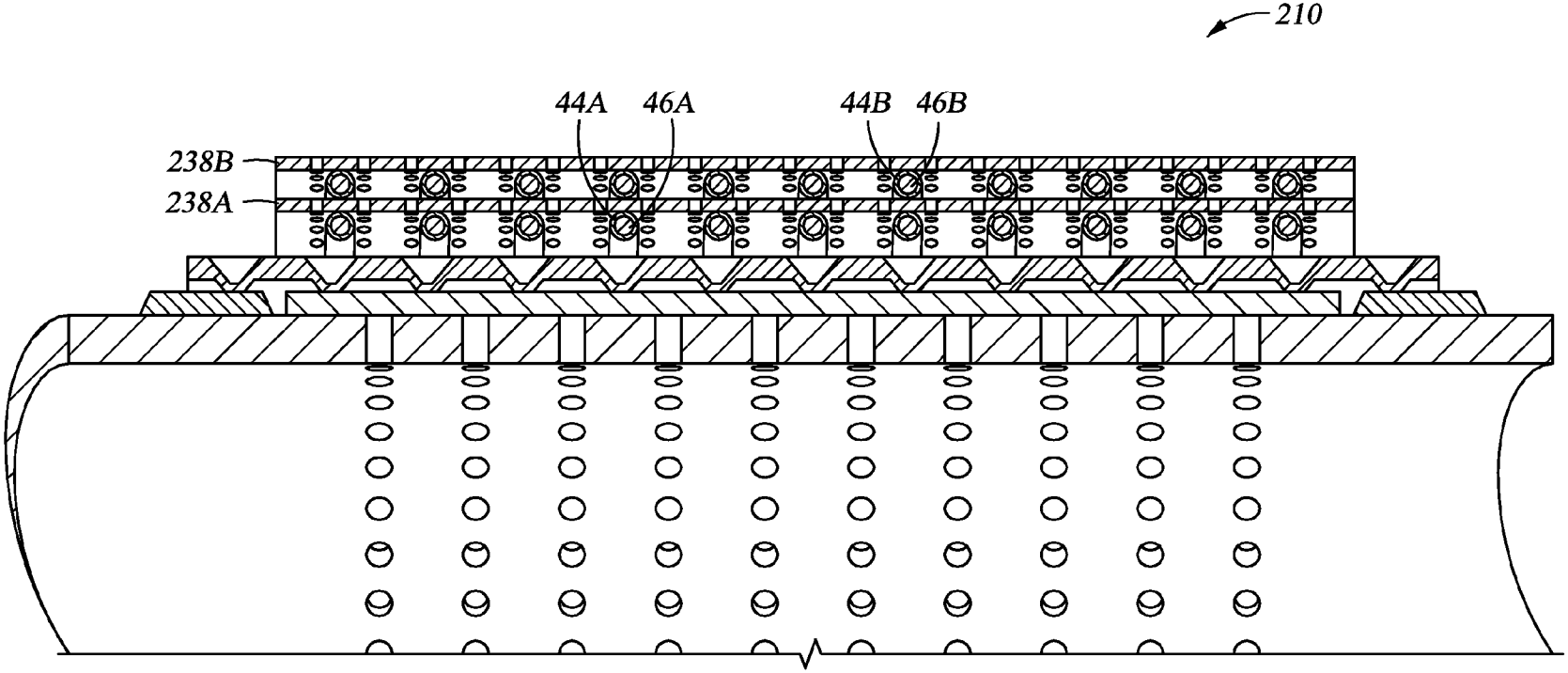
FIG. 3 depicts a schematic cross-sectional view of another embodiment of a fiber support arrangement disclosed herein.

Referring to FIG. 3, an alternate embodiment of a fiber support arrangement 210 is illustrated. Instead of a the singular tubular 38 having the fiber conduits 44A and 44B attached to the opposing surfaces 42, 43 thereof, two separate tubulars 238A, 238B are employed. The conduit 44A is attached to an inner surface 42A of the tubular 238A, and the conduit 44B is attached to an inner surface 44B of the tubular 238B.

Figure 4:
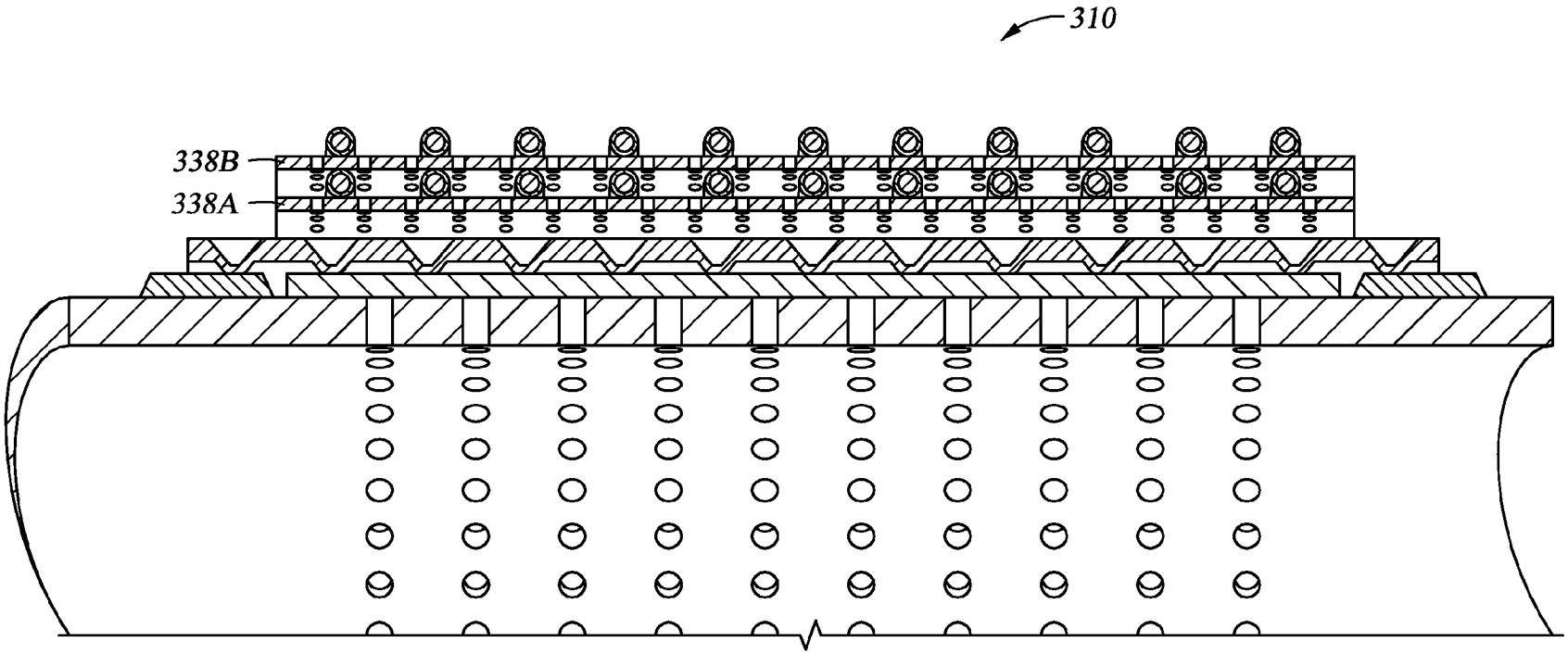
FIG. 4 depicts a schematic cross-sectional view of yet another embodiment of a fiber support arrangement disclosed herein.

Similarly, referring to FIG. 4, another alternate embodiment of a fiber support arrangement 310 is illustrated. As with the arrangement 210 the arrangement 310 includes two separate tubulars 338A, and 338B. A primary difference being that the fiber conduits 44A, 44B are attached to outer surfaces 43A and 43B of the tubulars 338A and 338B, respectively.

Additional embodiments having three tubulars or more substantially concentrically nested within each other with fiber conduits attached to inner or outer surfaces thereof are also contemplated. Having conduits positioned between tubulars may facilitate mechanical attachment of the conduits to the tubulars via swaging of the tubulars toward one another, thereby sandwiching the conduits therebetween. It should also be noted that any of the tubulars 38, 138A, 138B, 238A, 238B, 338A and 338B could be combined in an embodiment as long as the fibers are spaced from the downhole tool and at least two of the fibers have different helical angles from each other.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

The invention claimed is:

1. A fiber support arrangement for a downhole tool comprising:

at least one tubular;

at least one bracket positioning the at least one tubular spaced radially from a downhole tool and lacking contact therewith; and at least two fibers supported at the at least one tubular with at least two of the at least two fibers having a different helical angle from one another relative to an axis of the downhole tool, wherein a first fiber among the at least two fibers is positioned radially inwardly of an inner periphery of the at least one tubular and a second fiber among the at least two fibers is positioned radially outwardly of an outer periphery of the at least one tubular.

2. The fiber support arrangement for a downhole tool of claim 1, wherein the at least two fibers are strain transmissively mounted at the at least one tubular.

3. The fiber support arrangement for a downhole tool of claim 1, wherein the at least one tubular further includes a conduit strain transmissively mounted thereto and enveloping at least one of the at least two fibers.

4. The fiber support arrangement for a downhole tool of claim 3, wherein the conduit contains between an inside dimension thereof and an outside dimension of the at least one of the at least two fibers a strain transmissive potting material.

5. The fiber support arrangement for a downhole tool of claim 4, wherein the strain transmissive potting material is epoxy.

6. The fiber support arrangement for a downhole tool of claim 3, wherein the conduit is mounted to the at least one tubular by at least one of welding, mechanical attachment and adhesive.

7. The fiber support arrangement for a downhole tool of claim 1, wherein the at least one bracket is two brackets.

8. The fiber support arrangement for a downhole tool of claim 1, wherein the at least one bracket includes a pass through for at least one of the at least two fibers.

9. The fiber support arrangement for a downhole tool of claim 8, wherein the pass through is sized to pass a conduit and at least one of the at least two fibers.

10. The fiber support arrangement for a downhole tool of claim 1, wherein the at least one of the at least two fibers is an optic fiber.

11. The fiber support arrangement for a downhole tool of claim 1, wherein the at least one tubular includes a first tubular and a second tubular.

12. The fiber support arrangement for a downhole tool of claim 1, wherein the first tubular is positioned radially inwardly of the second tubular.

13. The fiber support arrangement for a downhole tool of claim 1, wherein the first fiber is mounted at an inside surface of the first tubular and the second fiber is mounted at an inside surface of the second tubular and positioned radially outwardly of an outer periphery of the first tubular.

14. The fiber support arrangement for a downhole tool of claim 12, wherein the first fiber is mounted at an outside surface of the first tubular and positioned radially inwardly of an inner periphery of the second tubular and the second fiber is mounted at an outside surface of the second tubular.

15. The fiber support arrangement for a downhole tool of claim 12, wherein the first fiber is housed within a cleft created within the first tubular and positioned radially inwardly of an inner periphery of the second tubular and the second fiber is housed within a cleft created within the second tubular and positioned radially outwardly of an outer periphery of the first tubular.

16. The fiber support arrangement for a downhole tool of claim 1, wherein the at least one tubular is one tubular, and the first fiber is mounted radially inwardly of the one tubular and the second fiber is mounted radially outwardly of the one tubular.

17. The fiber support arrangement for a downhole tool of claim 1, wherein the at least one tubular houses at least one of the at least two fibers within a cleft created therein, the cleft being closed after insertion of the at least one of the at least two fibers.

18. A method for supporting fibers at a downhole tool comprising:

disposing a support at a downhole tool, the support being radially outwardly positioned of the downhole tool;

supporting the support with at least two brackets axially spaced from each end of the downhole tool such that the downhole tool is lacking contact with the support; and mounting at least two fibers at the support such that the at least two fibers lack contact with the downhole tool and have different helical angles relative to an axis of the downhole tool, wherein mounting at least two fibers at the support further includes mounting a first fiber among the at least two fibers at a position radially inwardly of an inner periphery of the support and mounting a second fiber among the at least two fibers at a position radially outwardly of an outer periphery of the support.

19. The method of claim 18, wherein the downhole tool is a screen.

* * * * *